US011049397B2

(12) United States Patent
Birchenko

(10) Patent No.: US 11,049,397 B2
(45) Date of Patent: Jun. 29, 2021

(54) LOW-PROFILE SURFACE-MOUNTED WIRELESS PARKING SENSOR

(71) Applicant: Nwave Technologies, Inc., Los Gatos, CA (US)

(72) Inventor: Yury Birchenko, Twickenham (GB)

(73) Assignee: Nwave Technologies, Inc., Los Gatos, CA (US)

( * ) Notice: Subject to any disclaimer, the term of this patent is extended or adjusted under 35 U.S.C. 154(b) by 0 days.

(21) Appl. No.: 16/375,703

(22) Filed: Apr. 4, 2019

(65) Prior Publication Data

US 2019/0311622 A1 Oct. 10, 2019

Related U.S. Application Data

(60) Provisional application No. 62/654,141, filed on Apr. 6, 2018.

(51) Int. Cl.
*G08G 1/14* (2006.01)

(52) U.S. Cl.
CPC ..... *G08G 1/145* (2013.01); *G08G 1/142* (2013.01)

(58) Field of Classification Search
CPC ..... G08G 1/145; G08G 1/142
See application file for complete search history.

(56) References Cited

U.S. PATENT DOCUMENTS

2007/0050240 A1* 3/2007 Belani ..... G08G 1/14 705/13
2009/0139338 A1* 6/2009 Suminto ..... G01L 19/04 73/727
2010/0117820 A1* 5/2010 Mitschele ..... G08G 1/147 340/539.1
2014/0139360 A1* 5/2014 Vilajosana Guillen ..... G08G 1/142 340/932.2
2016/0049077 A1* 2/2016 Sandbrook ..... G08G 1/142 340/932.2
2016/0306028 A1* 10/2016 Chang ..... G08G 1/142
2017/0098374 A1* 4/2017 Sullivan ..... H04W 4/44

* cited by examiner

*Primary Examiner* — Mohamed Barakat

(57) ABSTRACT

Embodiments of the present invention provide a low-profile, surface-mounted, wireless parking sensor (LPSMPS) that is easy-to-install, easy-to-maintain, easy-to-repair, and low-cost. The LPSMPS can support the weight of a typical motor vehicle without damage to the electronic components therein. The LPSMPS has a disk-like shape and houses a circular printed circuit board (PCB) that includes electronics for motor vehicle sensing and for wireless communication with other devices. Batteries (e.g., standard AA batteries) are positioned around the circular PCB to enable a low overall profile. For example, according to some embodiments, the maximum height of the LPSMPS is less than 20 mm.

16 Claims, 9 Drawing Sheets

LOW-PROFILE SURFACE-MOUNTED WIRELESS PARKING SENSOR

CROSS-REFERENCE TO RELATED APPLICATIONS

The present application claims priority to provisional application Ser. No. 62/654,141, filed on Apr. 6, 2018, entitled "A LOW-PROFILE, SURFACE-MOUNTED, WIRELESS PARKING SENSOR" naming the same inventors as in the present application. The contents of the above referenced provisional application are incorporated by reference, the same as if fully set forth herein.

FIELD

Embodiments of the present invention generally relate to the field of vehicle parking sensors. More specifically, embodiments of the present invention relate to surface-mounted wireless vehicle parking sensors.

BACKGROUND

A wireless parking sensor monitors the presence of a motor vehicle within a parking space. The wireless parking sensor communicates with a parking management system using a wireless protocol. The parking management system keeps track of which parking spaces are used and communicates real time information about parking use and spot availability to drivers, parking operators and other interested parties. The wireless parking sensor typically receives its power from a non-commodity, long-life battery.

Many wireless parking sensors are embedded in the parking surface to protect the sensors from the weight of the motor vehicles passing overhead. Embedding a wireless parking sensor in the parking surface complicates installation, drilling the asphalt or concrete is labor intensive, noisy and time-consuming operation. Recessed installation makes it more difficult to remove the sensor, for example, in case of road repair work, and makes battery replacement and other maintenance substantially more difficult.

Surface-mounted wireless parking sensors are different from in-surface sensors and are typically glued or screwed to the parking surface. Unfortunately, current surface mounted wireless parking sensors have a relatively high profile, and sometimes pedestrians or cyclists will trip over the sensors when walking over the parking spaces.

Parking management would be improved by a surface-mounted wireless parking sensor that was low-profile, low cost, easy-to-install, and easy-to-maintain.

SUMMARY OF THE INVENTION

Embodiments of the present invention provide a low-profile, surface-mounted, wireless parking sensor (LPSMPS) that is easy-to-install, easy-to-maintain, easy-to-repair, and low-cost. The LPSMPS of the present invention can support the weight of a typical motor vehicle without damage to the electronic components therein. The LPSMPS has a disk-like shape and houses a circular printed circuit board (PCB) that includes electronics for motor vehicle sensing and for wireless communication with other devices. Batteries (e.g., standard AA batteries) are positioned around the circular PCB to enable a low overall profile. For example, according to some embodiments, the maximum height of the LPSMPS is less than 20 mm.

According to one embodiment, a surface-mounted wireless parking sensor device is disclosed. The device includes an electronic circuit board comprising circuitry configured to determine proximity to a vehicle and to transmit information to a remote device responsive to detecting the vehicle, a central pillar protruding through the center of the electronic circuit board, where the central pillar connects casing components and supports a vehicle load, a plurality of batteries for powering the circuitry of the circuit board, where the batteries are disposed around the central pillar. The casing components include a sensor body component, a base component coupled to the sensor body, and a cap component disposed on a top surface of the sensor body and configured to distribute a load across a surface of the cap.

According to some embodiments, the sensor body component, the base component, and the cap component have a maximum height of approximately 20 mm.

According to some embodiments, the device includes a plurality of base pillars disposed around the central pillar that connects the casing components.

According to some embodiments, the central pillar is hollow, and the device includes a solid central pillar that is received by the central pillar to distribute the load across the base component.

According to some embodiments, the base component includes tapered sides that become wider towards a bottom surface of the base component to prevent the base component from being dislodged from a parking surface.

According to some embodiments, the device includes a hand grip disposed on a top surface of the cap component.

According to some embodiments, the sensor body component is coupled to the base component and the cap component using metal screws.

According to some embodiments, the cap component includes screw holes that are configured to receive the metal screws, and the screw holes include screw reinforcement side ribs configured to reduce a force exerted on the screws from the load.

According to some embodiments, the cap component includes a plurality of radial and annular ribs extending along an inner surface of the cap and configured to reduce bending of the cap component and to transfer a force of the load away from the circuit board.

According to some embodiments, the cap component includes a plurality of arch shaped ribs covering the battery compartment.

According to some embodiments, the cap component includes a circular rib, and the device includes an o-ring, where the o-ring is operable to support the circular rib to uniformly distribute the load, and where the circular rib compresses the o-ring to provide a hermetic seal to restrict moisture from passing through the seal.

According to some embodiments, the sensor body component, the base component, and the cap component include extruded plastic.

According to some embodiments, the base component includes a pocket disposed on a bottom surface of the base component and configured to receive an adhesive to fix the base component to a parking surface.

According to different embodiments, a wireless parking sensor is disclosed. The wireless parking sensor has a casing including a sensor body coupled to a base, where the base is configured to be fixed to an external surface, a cap coupled to a top surface of the sensor body, where the cap is configured to receive a load disposed on the cap and includes a rib to distribute the load. The device includes a circuit board disposed in the sensor body, where the circuit board is configured to determine proximity to a vehicle and to transmit information to a remote device responsive thereto, a plurality of batteries coupled to the circuit board and providing power to the circuit board using a wire, where the wire is disposed in a groove of the casing, and an o-ring disposed between the sensor body and the cap, where the o-ring is configured to support the rib, and where the o-ring is compressed by the rib to seal an interior cavity between the cap and the sensor body.

According to some embodiments, the o-ring is approximately 3 mm thick and is disposed in a groove to provide substantially uniform compression along the circular rib, and where the groove is approximately 4 mm deep.

According to some embodiments, the circuit board is circular and surrounds a hollow pillar, and the wireless parking sensor includes a plurality of batteries disposed around the hollow pillar, and a solid pillar disposed on the base that penetrates the hollow pillar to support the load of the cap.

BRIEF DESCRIPTION OF THE DRAWINGS

The accompanying drawings, which are incorporated in and form a part of this specification and in which like numerals depict like elements, illustrate embodiments of the present disclosure and, together with the description, serve to explain the principles of the disclosure.

DETAILED DESCRIPTION

Figure 1:
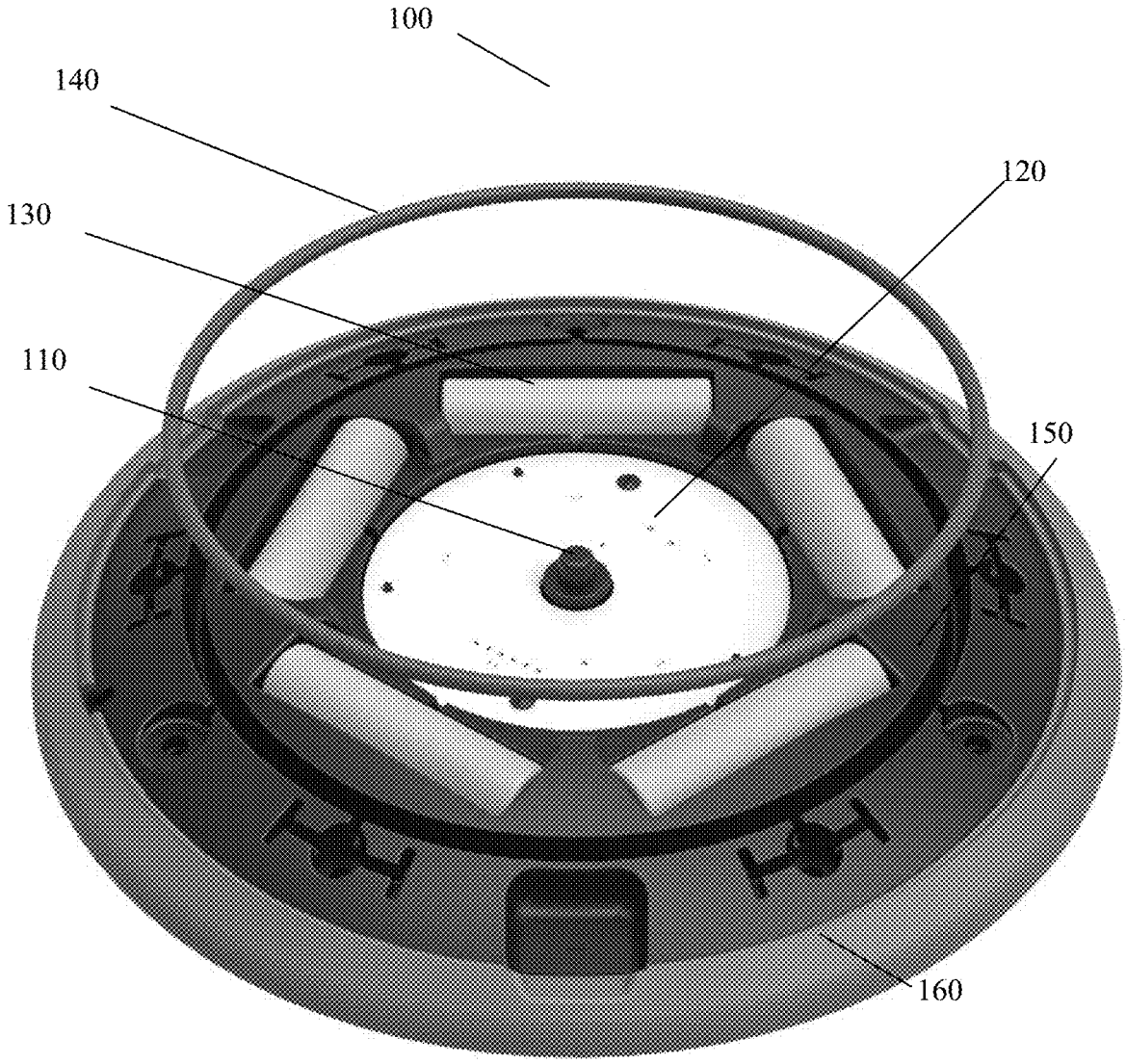
FIG. 1 is a diagram depicting an exemplary low-profile, surface-mounted, wireless parking sensor device according to embodiments of the present invention.

Reference will now be made in detail to several embodiments. While the subject matter will be described in conjunction with the alternative embodiments, it will be understood that they are not intended to limit the claimed subject matter to these embodiments. On the contrary, the claimed subject matter is intended to cover alternative, modifications, and equivalents, which may be included within the spirit and scope of the claimed subject matter as defined by the appended claims.

Furthermore, in the following detailed description, numerous specific details are set forth in order to provide a thorough understanding of the claimed subject matter. However, it will be recognized by one skilled in the art that embodiments may be practiced without these specific details or with equivalents thereof. In other instances, well-known methods, procedures, components, and circuits have not been described in detail as not to unnecessarily obscure aspects and features of the subject matter.

It should be borne in mind, however, that all of these and similar terms are to be associated with the appropriate physical quantities and are merely convenient labels applied to these quantities. Unless specifically stated otherwise as apparent from the following discussions, it is appreciated that throughout, discussions utilizing terms such as "accessing," "displaying," "writing," "including," "storing," "transmitting," "traversing," "determining," "identifying," "observing," "adjusting," or the like, refer to the action and processes of a computer system, or similar electronic computing device, that manipulates and transforms data represented as physical (electronic) quantities within the computer system's registers and memories into other data similarly represented as physical quantities within the computer system memories or registers or other such information storage, transmission or display devices.

Low-Profile Surface-Mounted Wireless Parking Sensor

Embodiments of the present invention provide a low-profile, surface-mounted, wireless parking sensor (LPSMPS) that is easy-to-install, easy-to-maintain, easy-to-repair, and low-cost. The LPSMPS can support the weight of a heavy motor vehicle without damage to the electronic components therein. The LPSMPS in one embodiment has a disk-like shape and houses a printed circuit board (PCB) that includes electronics for motor vehicle sensing and for wireless communication with other devices. In one embodiment, the PCB may be circular in shape. Batteries (e.g., standard AA batteries) are positioned around the circular PCB to enable a low overall profile. For example, according to some embodiments, the maximum height of the LPSMPS is less than 20 mm.

Moreover, embodiments of the present invention can use standard batteries (e.g., AA alkaline batteries) to lower the cost of the LPSMPS compared to traditional parking sensors that require fixed, non-replaceable batteries.

According to some embodiments, a central vertical pillar is included to support the weight of a motor vehicle when the motor vehicle is driving over or parked on top of the LPSMPS. Other features are included in the LPSMPS to help distribute a motor vehicle's weight across the device. For example, the LPSMPS can include ribbed battery compartment arches, radial and annular reinforcement ribs on the cap (e.g., in a net formation), and a load bearing structure with wire grooves disposed between the PCB and battery compartments that house the batteries.

According to some embodiments, the base is tapered or flared at the bottom so that the LPSMPS remains securely fixed to the parking surface and is not easily dislodged by the blade of a snow plow, for example.

FIG. 1 is a diagram showing an exemplary LPSMPS device 100 with the cap component removed for convenience of viewing according to embodiments of the present invention. The LPSMPS body 150 houses and supports a circular shaped PCB 120 and the batteries 130. The LPSMPS base 160 supports the LPSMPS body 150. A central, vertical pillar 110 connects to the LPSMPS base 160 and is capable of supporting the weight of a motor vehicle. The rubber O-ring 140 provides a hermetic seal to prevent moisture from entering the device. According to one embodiment, the LPSMPS body 150, the LPSMPS base 160, and the central, vertical pillar 110 are made of extruded, light-weight plastic. The circular PCB 120 includes electronics for motor vehicle sensing (e.g., a magnetic field sensor) and wireless communication (e.g., Bluetooth, WiFi, etc.) The batteries 130 are disposed around the outside of the circular PCB 120 in on embodiment at approximately the same vertical elevation to minimize the height of the LPSMPS 100. In one embodiment, the batteries 130 include five standard (e.g., alkaline) AA batteries, however, any suitable combination of well-known battery formats could be used.

Figure 2:
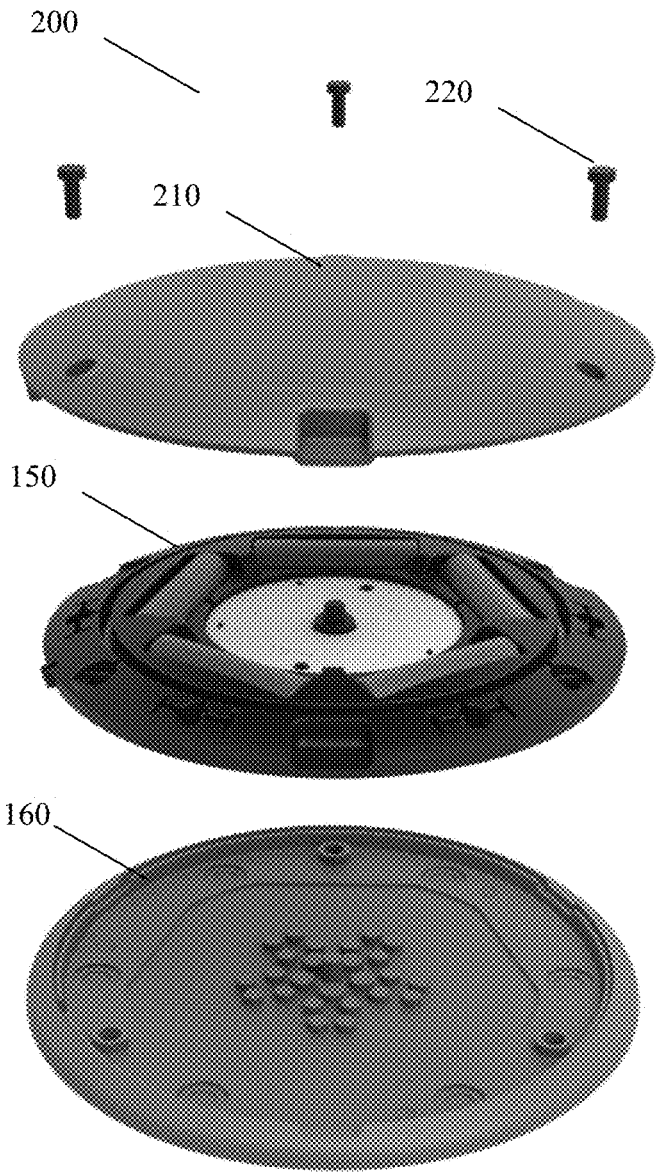
FIG. 2 is a diagram depicting an exemplary low-profile, surface-mounted, wireless parking sensor device with three separate components according to embodiments of the present invention.

FIG. 2 is a diagram depicting an exemplary LPSMPS device 200 with a cap component 210, a body component 150, and a base component 160 according to embodiments of the present invention. The cap component 210 covers the other components and functions to accept and distribute the weight of a motor vehicle or other forces exerted thereon. The body component 150 houses the electronics (e.g., a PCB) and batteries 130 while providing reliable structural support for the cap component 210. The base component 160 can be permanently attached to the parking surface and provides mechanical support to the body component 150. As shown, the components 210, 150, and 160 are circular in shape, but may have a different shape according to some embodiments. The cap component 210 can be coupled to the top of the LPSMPS body component 150, and the body component 150 can be coupled to the top of LPSMPS base component 160.

In the exemplary embodiment depicted in FIG. 2, the body component 150, the base component 160, and the cap component 210 are secured together using three metal screws 220 on the top side of the cap component 210, and six metal screws on the bottom side of the base component 160 (not pictured). Securing the components using screws makes it easy to disassemble the LPSMPS into its separate components and to perform maintenance such as replacing the batteries 130 or circular PCB 120. Using the same uniform light-weight plastic for the body component 150, the base component 160, and the cap component 210 provides an effective hermetic seal between the components.

Figure 3:
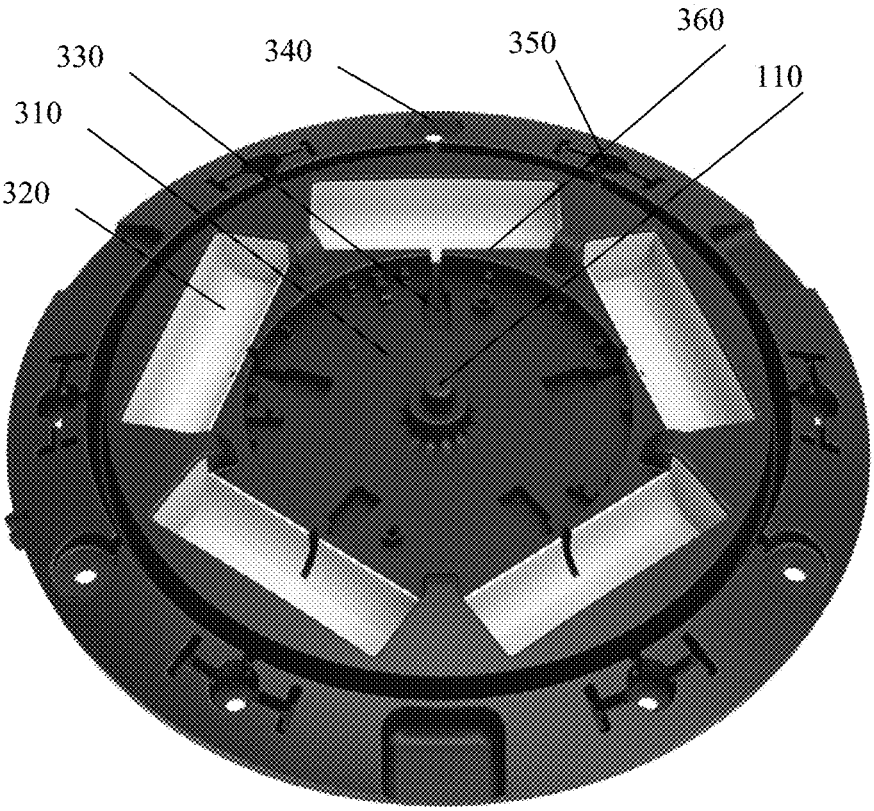
FIG. 3 is a diagram depicting a top view of an exemplary low-profile, surface-mounted, wireless parking sensor body component according to embodiments of the present invention.

FIG. 3 is a diagram depicting a top view of an exemplary LPSMPS body component 310 according to embodiments of the present invention. The central, vertical pillar 110 supports motor vehicle weights and is integral to the LPSMPS body 310 in this example. The LPSMPS body 310 includes a battery compartment 320 for securely holding the batteries in place. Battery wire groove 330 provides a channel for passing batteries wires through the load bearing structure 360 to connect the batteries 130 to the circular PCB 120. The LPSMPS body 310 includes screw holes 340 for securely coupling together the cap component 210, body component 310 and base component 160. The LPSMPS body includes screw holes 350 for connecting the cap component 210 to the body component 310.

Figure 4:
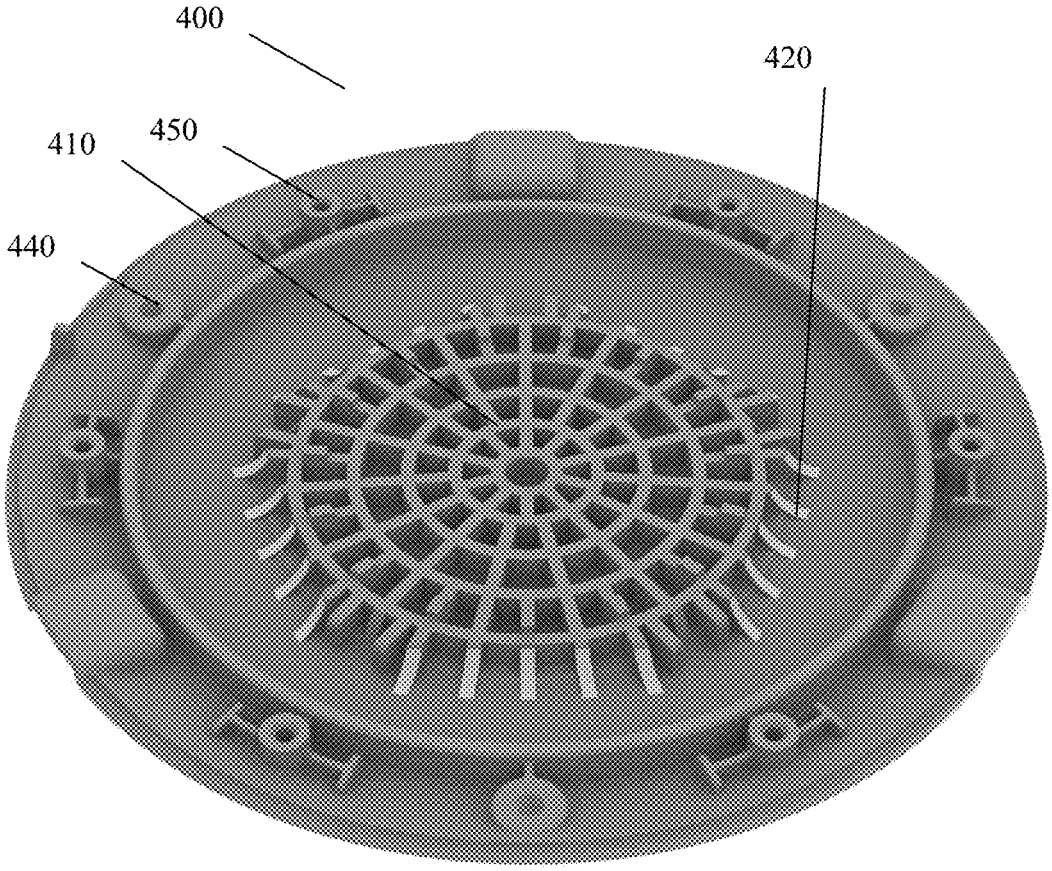
FIG. 4 is a diagram depicting a bottom view of an exemplary low-profile, surface-mounted, wireless parking sensor cap component according to embodiments of the present invention.

FIG. 4 is a diagram showing a bottom view of an exemplary LPSMPS cap component 400 according to embodiments of the present invention. A set of radial and annular ribs 410 are disposed on the inner surface of the cap component in the form of a net or web shape and prevent the cap from bending. The ribs 410 also help transfer the weight of a motor vehicle away from the PCB. Arched ribs 420 fit over the battery compartment 320 and protect the batteries 130. In the exemplary embodiment of FIG. 4, four arched ribs 420 protect each battery compartment 320. The LPSMPS cap 400 includes screw holes 440 for coupling the cap component 210, body component 150, and base component 160. The LPSMPS cap 400 includes screw holes 450 for coupling the cap component 210 to the body component 150. Screw hole 450 is reinforced with side ribs to sustain higher levels of torque without breaking and to distribute the compressing force from the screw point to adjacent areas more uniformly. In the embodiment depicted in FIG. 4, the LPSMPS cap 400 has six screw holes 450, however fewer or more can be used in suitable configurations.

Figure 5:
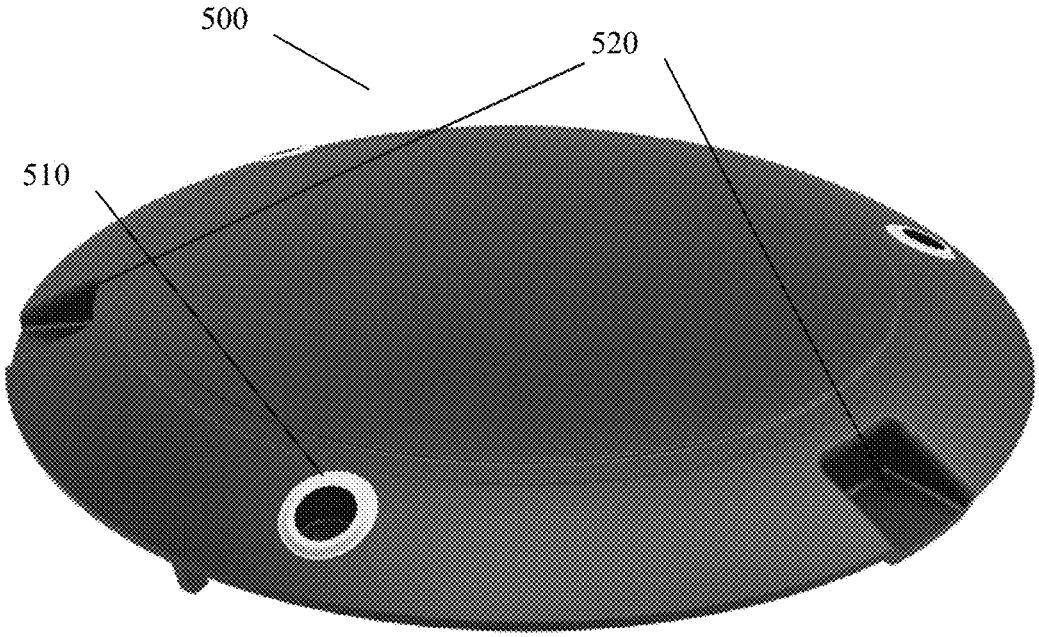
FIG. 5 is a diagram depicting a top view of an exemplary low-profile, surface-mounted, wireless parking sensor cap component according to embodiments of the present invention.

FIG. 5 is a diagram showing a top view of an exemplary LPSMPS cap component 500 according to embodiments of the present invention. The LPSMPS cap component 500 forms the upper component of the cap 210 depicted in FIG. 2. The LPSMPS cap 500 includes screw reinforcement ridges 510 to distribute stress caused by the weight of a motor vehicle driving or parking on the LPSMPS cap 500. The screw reinforcement ridges 510 consist of circular ridges of plastic with greater thickness around the screw hole. The LPSMPS cap 500 and/or the LPSMPS device 100 includes pockets 520 that provide a hand grip for use during handling and installation, and provides compartments to hold and protect informational stickers such as module serial number stickers, for example.

Figure 6:
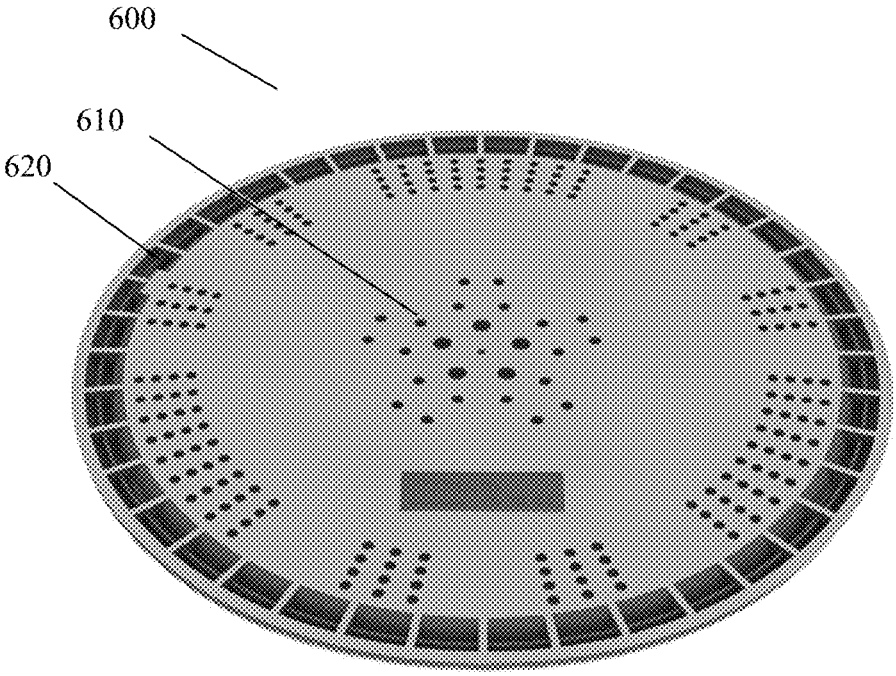
FIG. 6 is a diagram depicting a bottom view of an exemplary low-profile, surface-mounted, wireless parking sensor base component according to embodiments of the present invention.

FIG. 6 is a diagram depicting a bottom view of an exemplary LPSMPS base 600 component according to embodiments of the present invention. Base holes 610 and pockets 620 facilitate adhesion when the LPSMPS 100 is installed/glued onto a parking surface, with the bottom side facing down.

Figure 7:
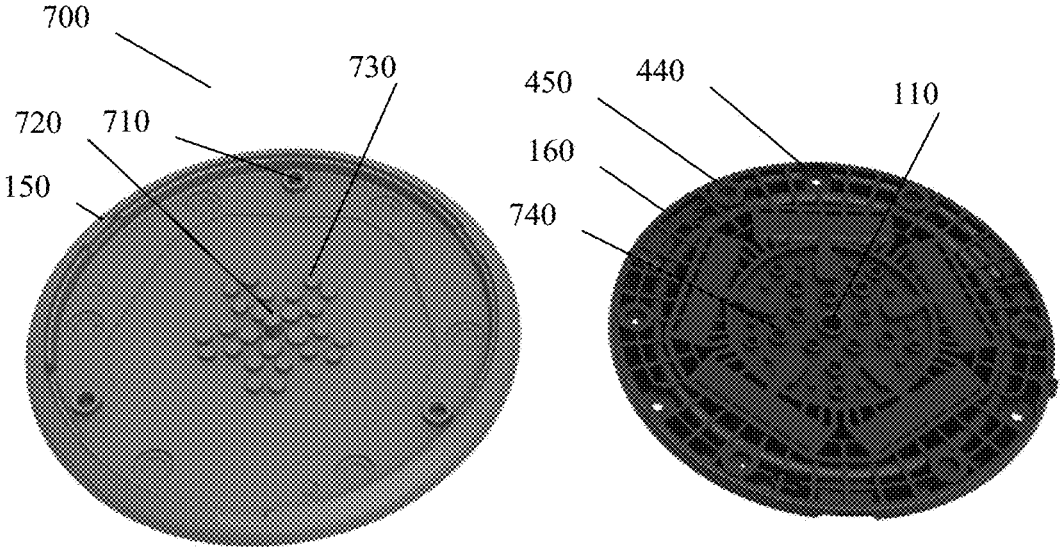
FIG. 7 is a diagram showing a top view of an exemplary low-profile, surface-mounted, wireless parking sensor base component and a bottom view of an exemplary low-profile, surface-mounted, wireless parking sensor body component according to embodiments of the present invention.

FIG. 7 is a diagram depicting an exemplary LPSMPS device 700, including a top view of a LPSMPS base component 150 and a bottom view of an LPSMPS body component 160 according to embodiments of the present invention. The LPSMPS body component 160 can be secured on top of the LPSMPS base 150 using base screw holes 710 aligned with body screw holes 440, the base central pillar 720 aligned with the body central pillar 110, and the base pillars 730 aligned with interlocking body cavities 740. The base central pillar 720 and the body central pillar 110 form a central pillar capable of supporting motor vehicle weights.

The base pillars 730 interlock with body cavities 740 to provide improved coupling between the base and body and provide additional support for the central pillar 720. Body screw holes 450 are shown in the bottom view.

Figure 8:
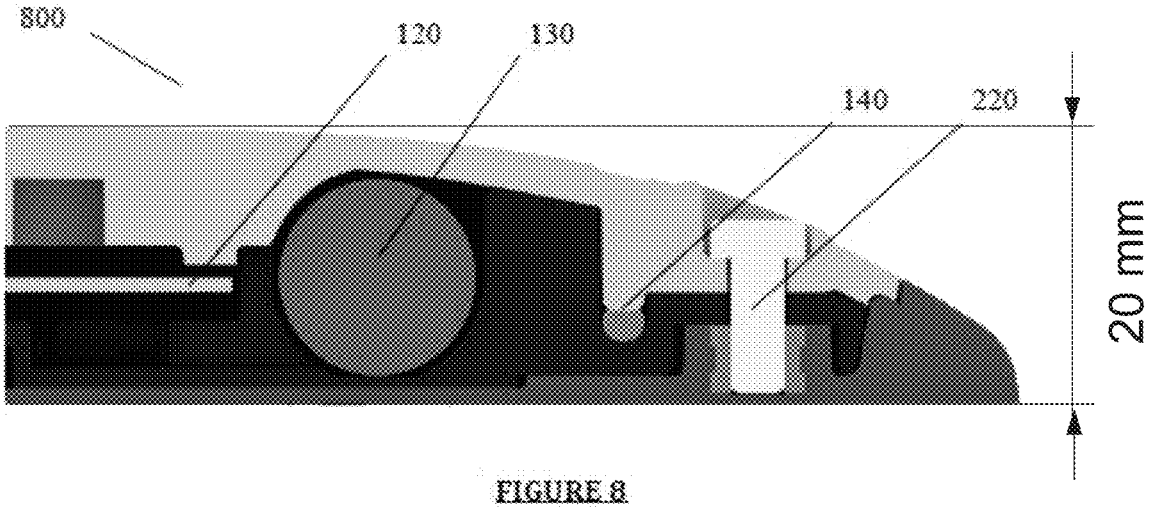
FIG. 8 is a diagram depicting a first side-view, cross-section of an exemplary low-profile, surface-mounted, wireless parking sensor device according to embodiments of the present invention.

FIG. 8 is diagram depicting a side-view and cross-section of an exemplary LPSMPS device 800 according to embodiments of the present invention. This cross-section view shows the circular PCB 120, the battery 130, the O-ring 140 and the screw 220. The maximum height of LPSMPS device 800 is approximately 20 mm according to this embodiment.

Figure 9:
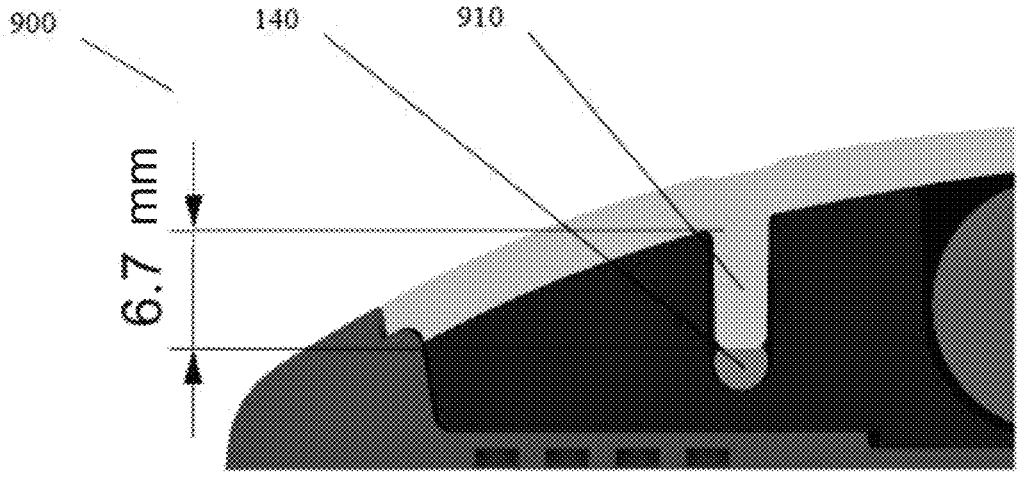
FIG. 9 is a diagram depicting a second side-view, cross-section of an exemplary low-profile, surface-mounted, wireless parking sensor device according to embodiments of the present invention.

FIG. 9 is a diagram depicting a side-view and cross-section of an exemplary LPSMPS device 900 according to embodiments of the present invention. The embodiment depicted in FIG. 9 does not include screw 220. The rubber O-ring 140 supports a circular rib 910 on the cap to provide robust and uniform support for heavy loads placed on the cap, such as the weight of a motor vehicle. According to some embodiments, the circular rib 910 has length of approximately 6.7 mm, and the O-ring has a thickness of 3 mm. According to some embodiments, the circular rib 910 has a length of at least 3 mm and a groove depth of at least 4 mm to provide reliable sealing, particularly in the areas between screws.

Figure 10:
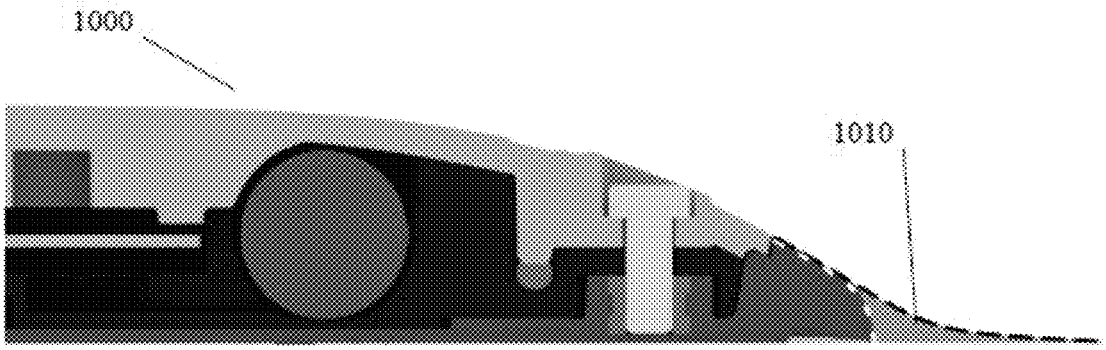
FIG. 10 is a diagram depicting a side-view, cross-section of an exemplary low-profile, surface-mounted, wireless parking sensor device for cold weather conditions according to embodiments of the present invention.

FIG. 10 is a diagram depicting a side-view and cross-section of an exemplary LPSMPS device 1000 configured for cold weather conditions according to embodiments of the present invention. In this example, the LPSMPS 1000 includes a relatively long, tapered edge 1010. According to some embodiments, a plastic sheath is attached to a standard LPSMPS base to achieve the tapered edge 1010. The tapered edge 1010 is configured to lie flat on a parking surface and resists horizontal forces, for example, from snow-clearing equipment (e.g., a snow plow blade).

Figure 11A:
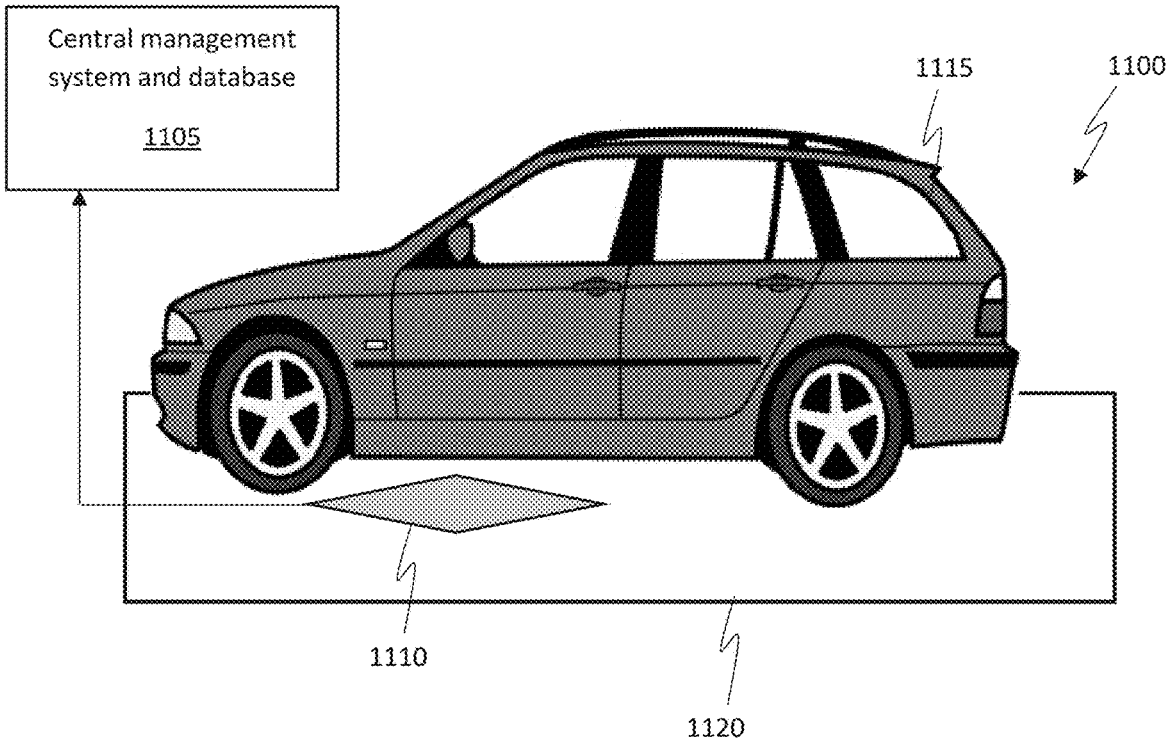
FIG. 11A is a diagram depicting an exemplary vehicle detection system including an LPSMPS device for detecting the presence of a motor vehicle according to embodiments of the present invention.

FIG. 11A is a diagram depicting an exemplary vehicle detection system 1100 including an LPSMPS device 1110 for detecting an occupancy status change, such as the presence of a motor vehicle 1115, according to embodiments of the present invention. The LPSMPS device 1110 communicates wirelessly with a central management system and database 1105 for managing a database of vacant and occupied parking slots or stalls 1120 based on the vehicle detection performed by LPSMPS device 1100.

Figure 11B:
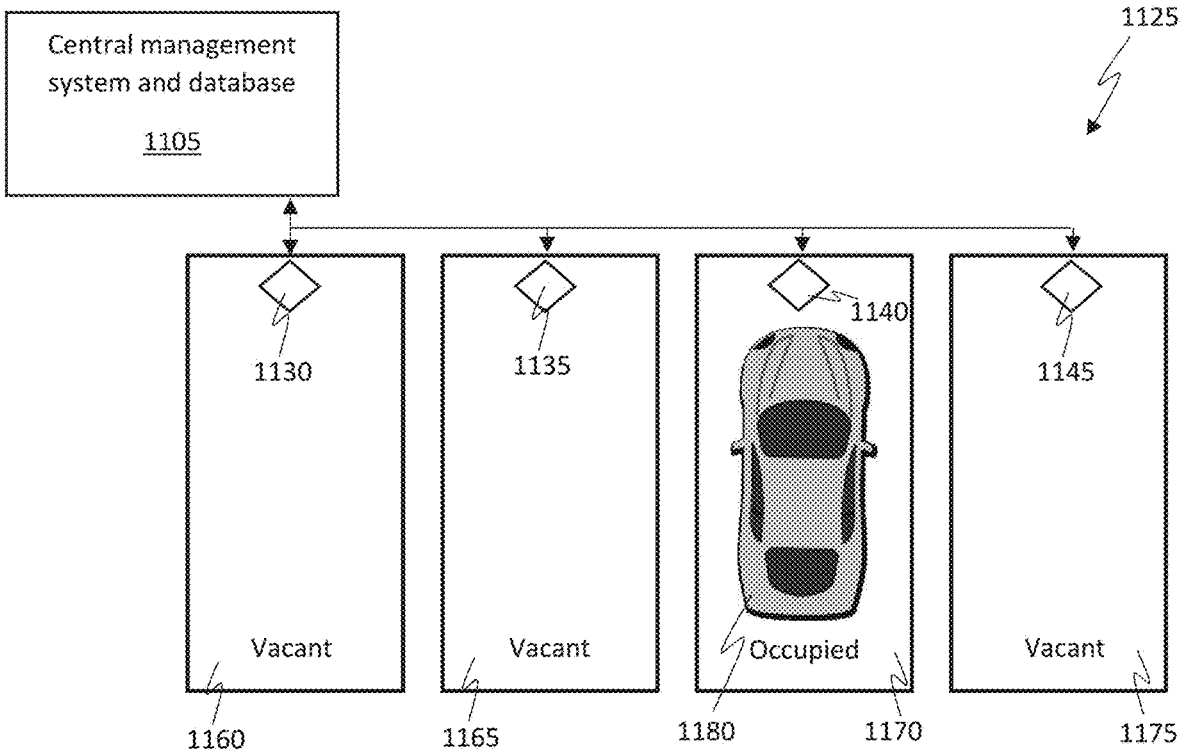
FIG. 11B is a diagram depicting an exemplary vehicle detection system including a plurality of LPSMPS devices fixed to surfaces of parking spaces according to embodiments of the present invention.

FIG. 11B is a diagram depicting an exemplary vehicle detection system 1125 including a plurality of LPSMPS devices 1130, 1135, 1140, and 1145 fixed to surfaces of parking spaces 1160, 1165, 1170, and 1175, according to embodiments of the present invention. The LPSMPS devices 1130, 1135, 1140, and 1145 communicate wirelessly with central management system and database 1105 for managing a database of vacant and occupied parking slots or stalls based on the vehicle detection performed by the LPSMPS devices 1130, 1135, 1140, and 1145. For example, parking space 1170 is occupied by vehicle 1180, and the occupancy status change of space 1170 is detected and stored in central management system and database 1105. Parking spaces 1160, 1165, and 1175 are vacant because no vehicle is detected by LPSMPS devices 1130, 1135, and 1145.

Figure 12:
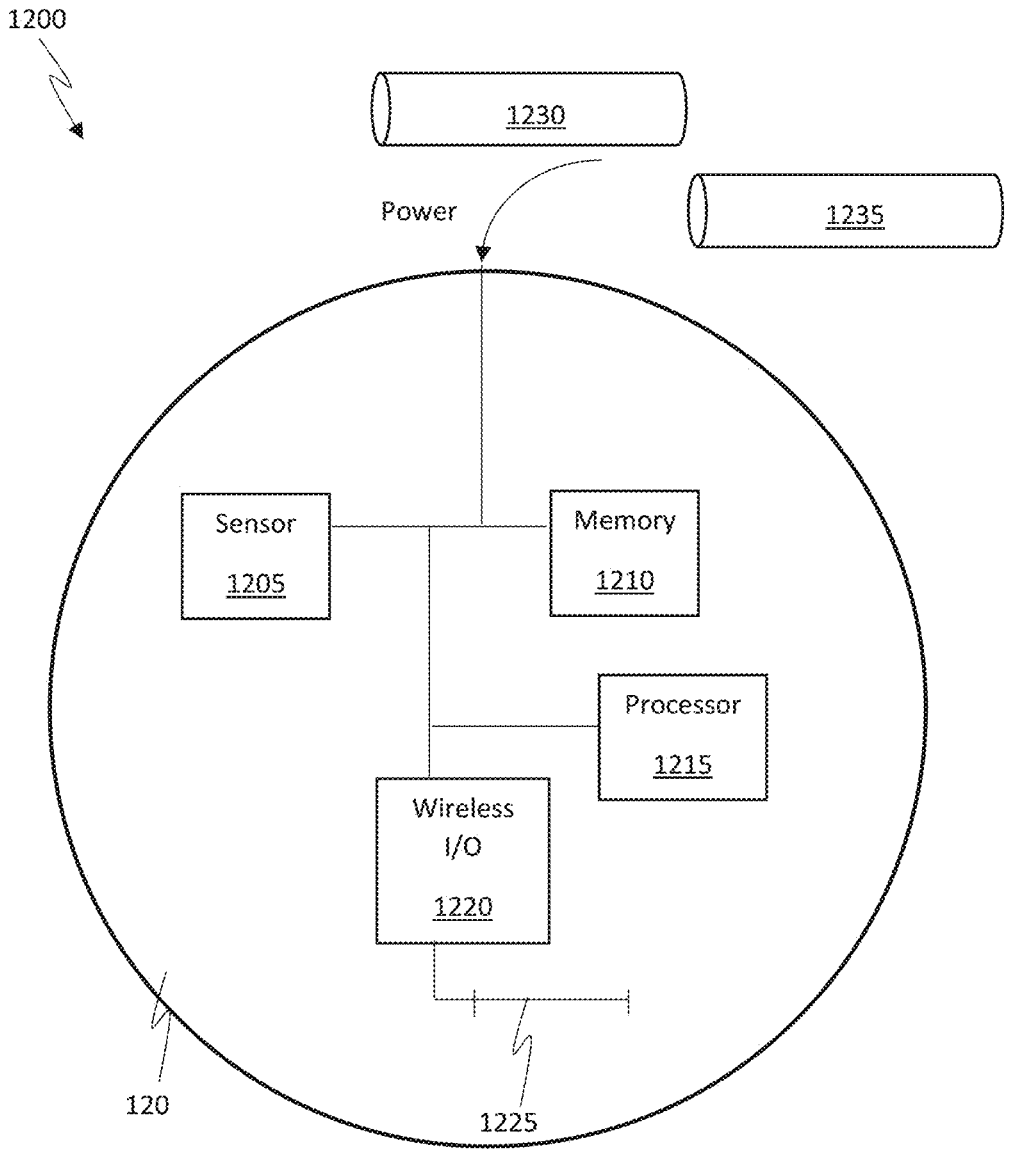
FIG. 12 is a block diagram of an exemplary circuit board of an LPSMPS device for detecting the presence of a motor vehicle according to embodiments of the present invention.

FIG. 12 is a block diagram of an exemplary circuit board 120 of an LPSMPS device 1200 for detecting the presence of a motor vehicle according to embodiments of the present invention. The circuit board 1200 includes a sensor 1205 for detecting the presence of a motor vehicle, a memory 1210 for storing data, a processor 1215, and a wireless input/output system 1220 (e.g., WiFi, Bluetooth, etc.) for communicating with external devices using antenna 1225. The circuit board 120 is powered by a plurality of batteries 1230 and 1235.

All examples and conditional language recited herein are intended for pedagogical purposes to aid the reader in understanding the principles of the invention and the concepts contributed by the inventor to furthering the art and are to be construed as being without limitation to such specifically recited examples and conditions. Moreover, all statements herein reciting principles, aspects, and embodiments of the invention, as well as specific examples thereof, are intended to encompass both structural and functional equivalents thereof. Additionally, it is intended that such equivalents include both currently known equivalents as well as equivalents developed in the future, i.e., any elements developed that perform the same function, regardless of structure.

Embodiments of the present invention are thus described. While the present invention has been described in particular embodiments, it should be appreciated that the present invention should not be construed as limited by such embodiments, but rather construed according to the following claims.

What is claimed is:

1. A surface-mounted wireless parking sensor device comprising:

an electronic circuit board comprising circuitry configured to determine proximity to a vehicle and to transmit information to a remote device responsive to detecting the vehicle;

a first central pillar protruding through the center of the electronic circuit board, wherein the first central pillar is hollow and connects casing components and supports a vehicle load;

a second central pillar that is received by the first central pillar to distribute the load across a base component;

one or more batteries for powering the circuitry of the circuit board, wherein the batteries are disposed around the first central pillar;

the casing components comprising:

a sensor body component;

the base component coupled to the sensor body; and a cap component disposed on a top surface of the sensor body and configured to distribute a load across a surface of the cap.

2. A surface-mounted wireless parking sensor device as described in claim 1, wherein the sensor body component, the base component, and the cap component comprise a maximum height of approximately 20 mm.

3. A surface-mounted wireless parking sensor device as described in claim 1, further comprising a plurality of base pillars disposed around the first central pillar that connects the casing components.

4. A surface-mounted wireless parking sensor device as described in claim 1, wherein the coupled base component comprises flared edges that extend outward from the base parking sensor device and lie flat on the parking surface to prevent the base component from being dislodged from a parking surface.

5. A surface-mounted wireless parking sensor device as described in claim 1, further comprising a hand grip disposed on a top surface of the cap component.

6. A surface-mounted wireless parking sensor device as described in claim 1, wherein the sensor body component is coupled to the base component and the cap component using a plurality of metal screws.

7. A surface-mounted wireless parking sensor device as described in claim 6, wherein the cap component comprises screw holes that are configured to receive the metal screws, and wherein further the screw holes comprise screw reinforcement side ribs configured to reduce a force exerted on the screws from the load.

8. A surface-mounted wireless parking sensor device as described in claim 1, wherein the sensor body component further comprises one or more batteries disposed at locations on the sensor body component that are intersected by the circuit board plane.

9. A surface-mounted wireless parking sensor device as described in claim 1, wherein the cap component comprises a plurality of radial and annular ribs extending along an inner surface of the cap component and configured to reduce bending of the cap component and to transfer a force of the load away from the circuit board.

10. A surface-mounted wireless parking sensor device as described in claim 1, wherein the cap component comprises a plurality of arch shaped ribs covering the battery compartment.

11. A surface-mounted wireless parking sensor device as described in claim 1, wherein the cap component further comprises a circular rib, and further comprising an o-ring, wherein the o-ring is operable to support the circular rib to uniformly distribute the load, and wherein the circular rib compresses the o-ring to provide a hermetic seal to restrict moisture from passing through the seal.

12. A surface-mounted wireless parking sensor device as described in claim 1, wherein the plurality of batteries comprises standard AA batteries.

13. A surface-mounted wireless parking sensor device as described in claim 1, wherein the base component further comprises a pocket disposed on a bottom surface of the base component and configured to receive an adhesive to fix the base component to a parking surface.

14. A method of vehicle parking management using a low profile surface mounted wireless parking sensor device, the method comprising:

attaching a low profile surface mounted wireless parking device, that supports the weight of a motor vehicle without damage to electronic components within, to a parking location;

sensing the presence of a motor vehicle using the electronic components for motor vehicle sensing within the low profile surface mounted wireless parking device; and wirelessly communicating the sensed information with other devices to enable vehicle parking management, wherein the low profile surface mounted wireless parking device comprises:

a first central pillar protruding through an electronic circuit board, wherein the first central pillar is hollow, connects casing components of the low profile surface mounted wireless parking device, and supports a vehicle load; and a second central pillar that is received by the first central pillar to distribute the vehicle load across a base component of the low profile surface mounted wireless parking device, and wherein the electronic circuit board comprises electronic components for motor vehicle sensing and wireless communication to other devices.

15. The method of claim 14, wherein a plurality of batteries power the electronic components on the electronic circuit board.

16. The method of claim 14, wherein the casing components are coupled to the base component using a plurality of metal screws.

* * * * *